US009091265B2

(12) United States Patent
Figura

(10) Patent No.: US 9,091,265 B2
(45) Date of Patent: Jul. 28, 2015

(54) GEAR PUMP WITH CONTINUOUS VARIABLE OUTPUT FLOW RATE

(76) Inventor: Pavol Figura, Pieštany (SK)

( * ) Notice: Subject to any disclaimer, the term of this patent is extended or adjusted under 35 U.S.C. 154(b) by 215 days.

(21) Appl. No.: 13/261,455

(22) PCT Filed: Apr. 4, 2011

(86) PCT No.: PCT/SK2011/000009

§ 371 (c)(1),
(2), (4) Date: Oct. 4, 2012

(87) PCT Pub. No.: WO2011/129776

PCT Pub. Date: Oct. 20, 2011

(65) Prior Publication Data

US 2013/0039794 A1 Feb. 14, 2013

(30) Foreign Application Priority Data

Apr. 12, 2010 (SK) ..... 45-2010 U
Jun. 25, 2010 (SK) ..... 80-2010 U
Oct. 4, 2010 (SK) ..... 144-2010 U

(51) Int. Cl.
*F01C 20/18* (2006.01)
*F01C 1/18* (2006.01)
(Continued)

(52) U.S. Cl.
CPC . *F04C 2/18* (2013.01); *F04C 2/084* (2013.01); *F04C 14/185* (2013.01)

(58) Field of Classification Search
CPC ..... F04C 2/08; F04C 14/223; F04C 15/04; F04C 29/00; F04C 21/0863; F04C 14/18; F04C 14/185; F04C 2/18; F04C 14/195
USPC ..... 418/28–31, 191–193, 21–24, 132, 205, 418/16, 19, 75–77; 417/447.8, 359, 429, 417/212
See application file for complete search history.

(56) References Cited

U.S. PATENT DOCUMENTS 2,456,524 A 4/1949 Fernstrum ..... 103/126
5,184,947 A * 2/1993 Coombe ..... 418/20
(Continued)

FOREIGN PATENT DOCUMENTS

| | | | |
|---|---|---|---|
| DE | 101 56 977 A1 | 7/2003 | ..... F03C 2/08 |
| EP | 478514 A1 | 4/1992 | ..... F04C 15/04 |
| GB | 890507 | 2/1962 | |
| GB | 1539515 | 1/1979 | ..... F04C 1/08 |
| WO | 99/57438 A1 | 11/1999 | ..... F04C 15/04 |

*Primary Examiner* — Kenneth Bomberg
*Assistant Examiner* — Deming Wan
(74) *Attorney, Agent, or Firm* — Ohlandt, Greeley, Ruggiero & Perle, L.L.P.

(57) ABSTRACT

Gear pump with continuous variable output flow rate, comprises at least one first gear (3) is mounted on the first shaft (1), at least one second gear (4) is mounted on the second shaft (2), the first gear (3) and the second gear (4) are arranged axially movably against each other, the first gear (3) comprises the first ring (5) with flow passages (50), fitted on the first gear (3) tightly co-axially, the second gear (4) comprises the second ring (6) with flow passages (50), fitted on the second gear (4) tightly co-axially, whereas the first ring (5) is movable with the second gear (4) and the second ring (6) is movable with the first gear (3), the first gear (3) is sealed at one end by the first sealing (7) of the first gear (3) and at the other end by the second sealing (9) of the first gear (3), whereas sealings (7, 9) of the first gear (3) are arranged on the first shaft (1), the second gear (4) is sealed at one end by the first sealing (10) of the second gear (4) and at the other end by the second sealing (8) of the second gear (4), whereas sealings (10, 8) of the second gear (4) are arranged on the second shaft (2).

21 Claims, 17 Drawing Sheets

(51) Int. Cl.

| | |
|---|---|
| ***F01C 1/24*** | (2006.01) |
| ***F03C 2/00*** | (2006.01) |
| ***F03C 4/00*** | (2006.01) |
| ***F04C 2/00*** | (2006.01) |
| ***F04C 14/18*** | (2006.01) |
| ***F04C 28/18*** | (2006.01) |
| ***F04C 29/00*** | (2006.01) |
| ***F04C 2/18*** | (2006.01) |
| ***F04C 2/08*** | (2006.01) |

(56) References Cited

U.S. PATENT DOCUMENTS

| | | | | |
|---|---|---|---|---|
| 5,306,127 | A * | 4/1994 | Kinney | 418/21 |
| 5,620,315 | A * | 4/1997 | Pfuhler | 418/21 |
| 5,624,015 | A * | 4/1997 | Johnson | 192/61 |
| 5,724,812 | A * | 3/1998 | Baker | 60/490 |
| 7,686,601 | B2 * | 3/2010 | O'Brien, II | 418/206.6 |
| 2001/0024618 | A1 * | 9/2001 | Winmill | 418/1 |
| 2007/0237666 | A1 * | 10/2007 | O'Brien, II | 418/191 |

* cited by examiner

GEAR PUMP WITH CONTINUOUS VARIABLE OUTPUT FLOW RATE

This Patent Application is a US National Phase Patent Application from PCT Application No. PCT/SK2011/000009, filed Apr. 4, 2011 and claiming priority from Slovak Republic Patent Application Nos. PUV 45-2010 filed Apr. 12, 2010, PUV 80-2010 filed Jun. 25, 2010 and PUV 144-2010 filed Oct. 4, 2010.

TECHNICAL FIELD

The invention relates to gear pumps with continuous variable output flow rate.

BACKGROUND ART

Gear pumps are widely used mainly in lubrication, hydraulics and so. In majority, they are designed for specific conditions and it is not possible yet to change their output flow rate parameters during operation and even from zero output flow rate. However, they are necessary for proper lubrication of various engines, also for generation of pressure of liquids in wide range of use, e.g., piston movements, hydraulic motors, etc., and also as a part of hydraulic transmission, or as controlled volume pumps.

Currently known filed patents, as US 2001/0024618 A1 of Sep. 27, 2001 or WO 2006/049500 A1 of May 1, 2006 with axially translating gears have their limitations, which prevent their applicability.

Conventional gear pump has space between teeth, in which liquid medium is transported over its circumference, sealed at the end and on circumference, the most frequently, by gear pump housing that is made with sufficient sealing precision, and except gears with shafts nothing is movable.

Present invention can also greatly affect production of new types of hydraulic transmissions. It is because current transmissions cannot be without clutch mechanism.

SUMMARY OF INVENTION

Limitations of current state of the art, especially impossibility to vary output parameters of currently produced gear pumps, are eliminated by proposed solution. This solution allows to produce a gear pump, which is able to vary output parameters of flow rate in continuous manner from value 0 up to maximum constructional value of flow rate and pressure.

Principle of gear pump with continuous variable output flow rate according to this invention, is that, at least one first gear is mounted on the first shaft, at least one second gear is mounted on the second shaft, the first gear and the second gear are arranged axially movably against each other, the first gear comprises the first ring with flow passages, fitted on the first gear tightly co-axially, the second gear comprises the second ring with flow passages, fitted on the second gear tightly co-axially, whereas the first ring is movable with the second gear and the second ring is movable with the first gear, the first gear is sealed at one end by the first sealing of the first gear and at the other end by the second sealing of the first gear, whereas sealings of the first gear are arranged on the first shaft, the second gear is sealed at one end by the first sealing of the second gear and at the other end by the second sealing of the second gear, whereas sealings of the second gear are arranged on the second shaft.

Principle of present pump is thus that,

- we would allow to change so called active length of gear teeth by that we are able to move gears along their teeth and so change contact length of meshing teeth,
- we would prevent flow out of spaces between meshing teeth at both ends of these teeth of both gears by means of sealings and also by means of rings,
- we would divide gears to so called active and inactive parts, e.g. by rings, whose length would change and we would provide for that flow from higher pressure in spaces between teeth to lower pressure is not possible in these parts,
- we would allow free movement of rings along whole length of gears,
- we would allow free flow of medium from active to inactive part, and vice versa, of gears divided by rings, through flow passages in these rings,
- we would provide for, that the medium is not able to leak from spaces between teeth, from inactive part of gears, except flow passages in rings.

Principle of proposed pump is further in that, we would provide more movable parts, not only gears with shafts and pump housing, as it is with conventional gear pump, but also other statical and moving members and parts, which would help us to seal spaces between teeth also during movement of gears against each other according to axis of their rotation and prevent a leak of liquid medium from spaces between teeth of mutually moved gears.

For the sake of simplicity of technical solution we would assume that both gears have the same number of teeth and also the same length, have external teeth, and are reversible, thus they are able to roll in one and the other direction and rings with flow passages are the same and exactly follow the shape of gears on their entire circumference and they are whole. However, this is not essential. It means that gears can have different number of teeth, different diameter as well as length, also, gears can be made with external as well as internal teeth. In relation to the above mentioned, corresponding rings with flow passages can as well have different diameter, length, type of teeth and so, thus in relation to used type and size of gear teeth, and also size of gears.

For one-way pump, which has gear teeth rolling surface made only on one side of teeth, it is sufficient for rings or segments with flow passages to exactly follow the shape of the gears and seal the gears only on that flanks of teeth, which are rolling across each other, and this in minimal length of rolling of these teeth.

We slide over mutually meshed gears and moved against each other along the axis of rotation rings with flow passages, which will have greater diameter than diameter of gears and will exactly follow the shape of gears, but they will be able to slide along these gears so that the ring of drive gear will be in sliding contact with the side of driven gear and ring slid over driven gear will be in sliding contact with the side of drive gear. There will be flow passages in these rings, which number will be such as the number of teeth on corresponding gear. (The same is also the number of spaces between teeth of this gear). These flow passages, however, must be shaped and must be situated in the ring such that a flow from higher pressure on one side of tooth to lower pressure on the other side of this tooth, which is at the moment in mesh, could never occur through this flow passage. At this place, at certain moment where always, flow passage in the ring is closed by one of the teeth, for a moment (in the case of rotation of gears), or permanently (when pump is idle and stopped just right in this position), there is one space between teeth, which must be supplied or it must be allowed to remove such volume of medium from it, that no pressure shock or underpressure is created. Otherwise we would not be able to move rings and thereby gears. Due to this reason we will use compensating system, consisting of e.g. compensating cylinders with compensating pistons, which are to supply or remove just such volume from closed space between teeth, which allows free movement of rings in static and also in dynamic regime. However, these outlets of compensating system must be of such shape, also of such size and such situated, to provide compensation either in static or dynamic regime, and to never allow the outlet to be closed by at that moment passing tooth.

There exists group of pumps, which does not have to comprise said internal compensating system, because full closing of flow passages will not occur. These are pumps, which have drive side only on one side of tooth, reverse side of tooth is missing or is not used. We will call them one-way pumps.

For one-way pumps, or pumps having reversible gears that will be used as one-way pumps only, it is sufficient for rings or segments with flow passages to exactly follow the shape of gears and to seal them only on sides of teeth which are rolling across each other, and this, in minimal rolling length. Segments can be separate, or they can form together a ring.

In the case, exact output flow rate or exact displacement is required (e.g. for controlled volume pump and so), it is necessary, during moving of pump, and thus during the change of flow, to compensate, at the output of the pump with continuous variable output flow rate, volume of liquid medium resulting from the change of volume in active part of spaces between teeth at place where drive and driven gears roll across each other.

We call such compensating system external, because it is connected to output part of the pump and is able to supply or remove such volume of liquid medium, which is equal or proportional to the change of internal volume, which occurs during the moving due to change of rolling length of gears in active part of gears.

Internal as well as external compensating system can comprise cylinders with pistons, compensating pumps or reservoirs of liquid medium, whose operation, in the case they are used in given pump, will be functionally connected with its moving mechanism, or with movable parts of the pump. Internal compensating system can, however be, for some simple cases of pump application, replaced also by flow passages leading out of these closed spaces between teeth to the place of high or low pump pressure, or by their combination, and this in relation to requirement for easier movement of translation of rings with flow passages and gears in one or the other direction.

Internal as well as external compensating system works only during the moving, thus during the change of flow rate of pump.

This entire device can, for example, be mounted on pump housing, with which some parts of corresponding sealings are fixed in exact position without a possibility to move and to turn, such are both sealings on drive shaft. Drive shaft with gear and also auxiliary drive gear are allowed to move along their own axis only, and are mutually fixedly connected. Also ring of the driven gear is without a possibility to move along axis of driven shaft, but rotates together with driven gear. Driven shaft with gear, with both sealings, with ring of drive gear mounted slidably in movable and sealing sleeve, including auxiliary driven gear, can move in direction of axis of driven shaft within range of stops determining maximal and minimal flow, by means of moving mechanism connected with pump housing, whereas the shaft with driven gear and auxiliary gear can rotate also on its own axis simultaneously with drive mechanism.

Moving mechanism can involve various known power mechanisms based on mechanic, electric, hydraulic, pneumatic motion, and so, or their combinations, and this also with automatic control based on requested parameters. It will be able to continually set the flow of pump from "zero" flow up to "maximal" flow and back. It also will be able to move movable parts of the pump at maximum constructional flow and pressure or to stabilize it in given flow position. Thereby the pump will be "lockable" in given position. This can be understood also as safety element against misuse of equipment or machinery, which would comprise such pumps.

Auxiliary drive and driven gears, or other similar system provide synchronization system. This synchronization system provides for correct pump operation in so called zero flow regime and serves to maintain the same revolutions of both gears at the moment when these gears no more roll across each other, but gear rings are in sliding contact by their sides, as well as to provide correct operation of compensating system for supplying and removing the liquid medium from or to closed space between teeth.

Gear pumps with continuous variable output flow rate, which will not operate from zero flow rate, i.e. from zero flow regime, do not have to comprise synchronization system.

However, synchronization system also provides for correct operation of internal compensating system of the pump at zero flow regime, if it is used with the pump.

Synchronization system can also be made as chain transmission, indented belt transmission, also by means of existing synchronisms or lever transmission.

Zero output of the pump is obtained also by that drive and driven gears wiU roll across each other with defined minimal rolling length, which maintain their synchronous revolutions without any damage of teeth also at maximal output pressure (for example 1 mm). Thereby its minimal flow is given. This minimal flow is returned from pump outlet to inlet of the same pump through by-pass channel, in which throttle member is inserted. Output flow is in this case directly related to resistance on pump output and resistance of throttle member in by-pass channel. However, regulated pump output from zero flow rate to minimal flow rate is so obtained. At full shut-off of throttle member in by-pass channel the pump operates from minimal flow rate without limitation. However, it is in this manner achieved that it would not be necessary, for this group of pumps, to use synchronization system.

This gear pump is able to operate separately, but also it is able to cooperate with various hydraulic systems or devices.

When connecting such two gear pumps with continuous variable output flow rate, where one of them will be designed also for function of hydraulic motor, we are able to produce a transmission with theoretical ratio "1:0 up to 1:infinity (one to zero up to one to infinity)".

Regarding obvious fact, that each of the shafts can be drive as well as driven, the shafts and corresponding elements are hereinafter indicated as the first and the second, i.e. the first shaft, the second shaft, etc.

BRIEF DESCRIPTION OF DRAWINGS

The invention is better explained with drawings, where is represented in

DESCRIPTION OF EMBODIMENTS

Figure 1:
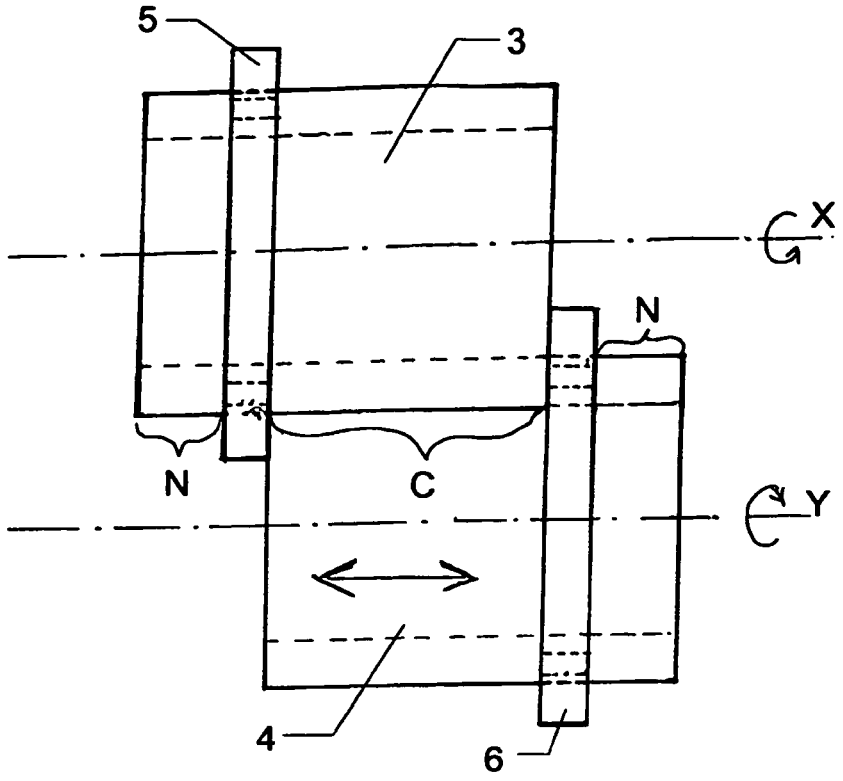
FIG. 1 an assembly of gears with rings in front view.
Figure 2:
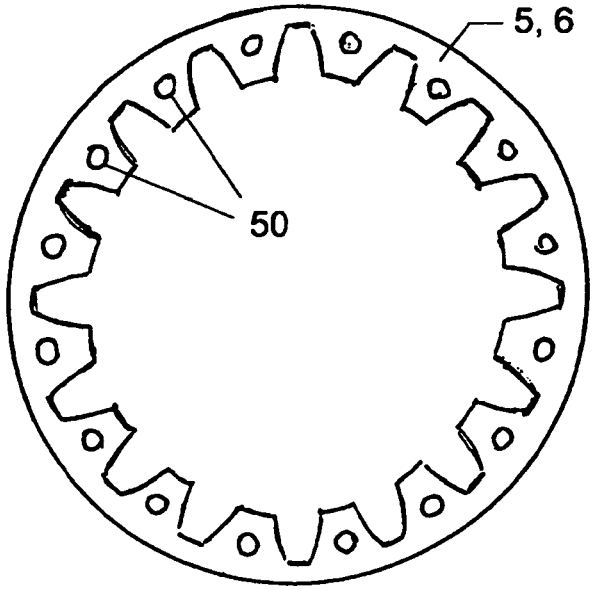
FIG. 2 a ring with flow passages.
Figure 3:
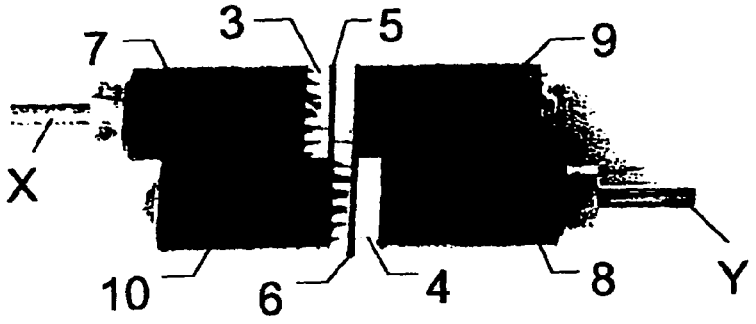
FIG. 3 an assembly of gears with rings and gear sealings in front view.
Figure 4:
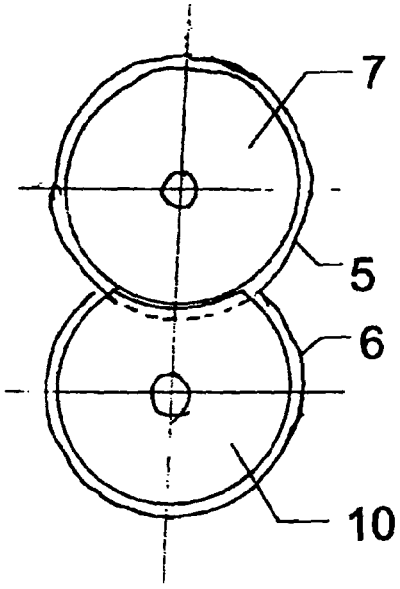
FIG. 4 left side view of the assembly of FIG. 3.
Figure 5:
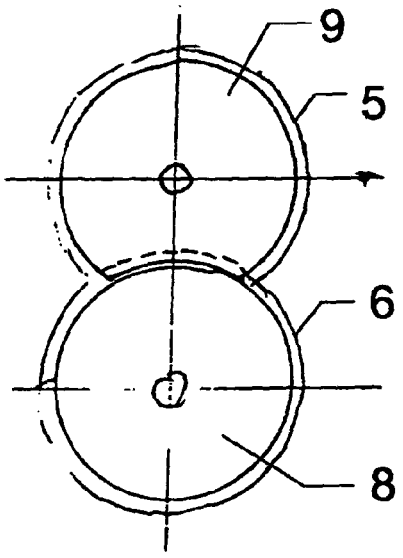
FIG. 5 right side view of the assembly of FIG. 3.
Figure 6:
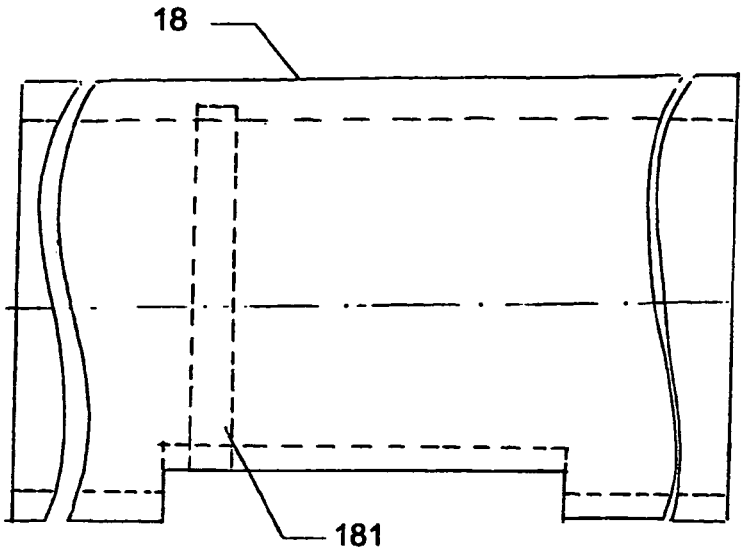
FIG. 6 sealing sleeve.
Figure 7:
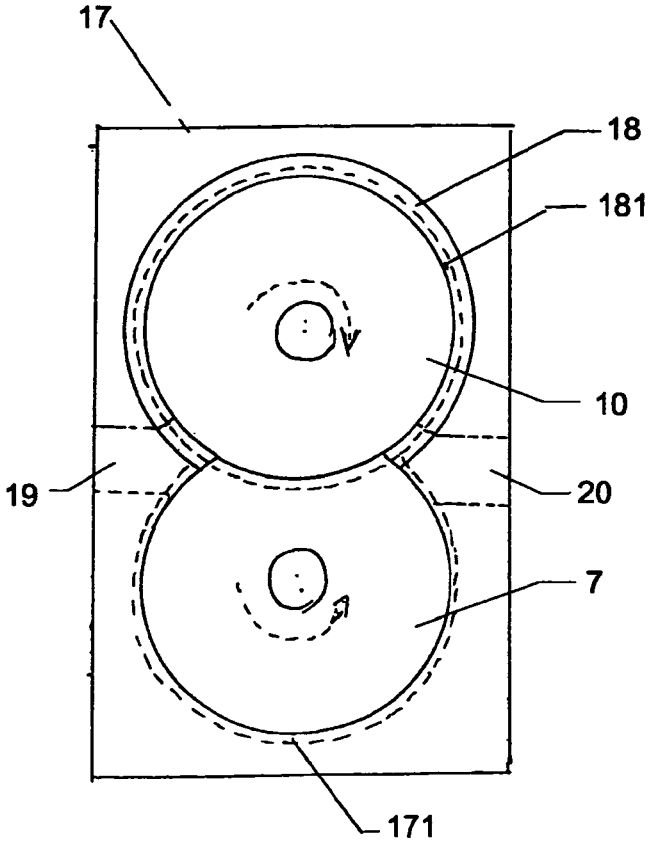
FIG. 7 side view of the pump.
Figure 8:
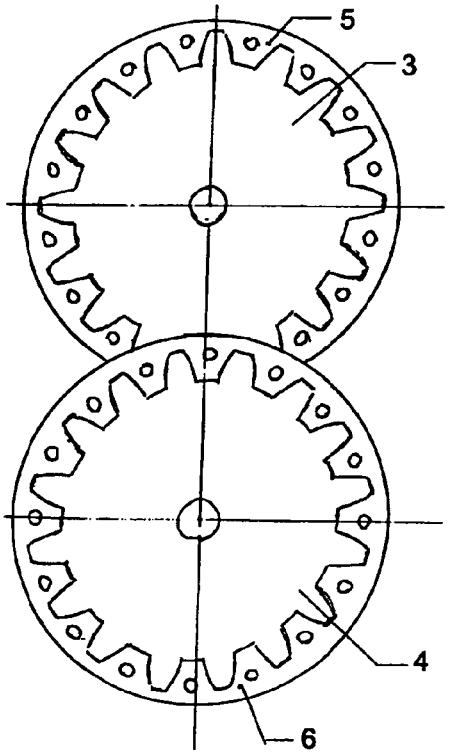
FIG. 8 right side view of the assembly of FIG. 1.
Figure 9:
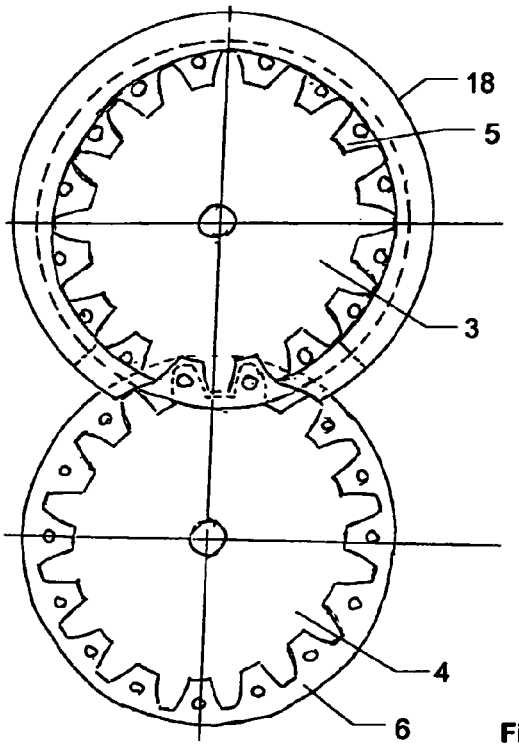
FIG. 9 left side view of the assembly of FIG. 1 with sealing sleeve of FIG. 6, FIG. 10 axonometric sectional view of the pump, FIG. 11 axonometric expanded, in direction of shaft axes, view of the pump FIG. 12 front sectional view of the pump, FIG. 13 mutual position of gears and rings with flow passages in three positions of flow-maximal flow-maximum, minimal flow, in this case zero flow-minimum and half flow-50% flow, FIG. 14 connection and fixing by pins of sealing sleeve and sealings of the second gear, FIG. 15 rings with flow passages of FIG. 10 to FIG. 13, FIG. 16 pump housing, FIG. 17 sliding and sealing sleeve, FIG. 18 the first sealing of the second gear with groove for the ring, with holes for stabilizing pins and threaded shifting rod, FIG. 19 the second sealing of the first gear with groove for the ring, FIG. 20 the first sealing of the first gear with compensating cylinder, FIG. 21 the second sealing of the second gear with compensating cylinder and holes for stabilizing pins.
Figure 10:
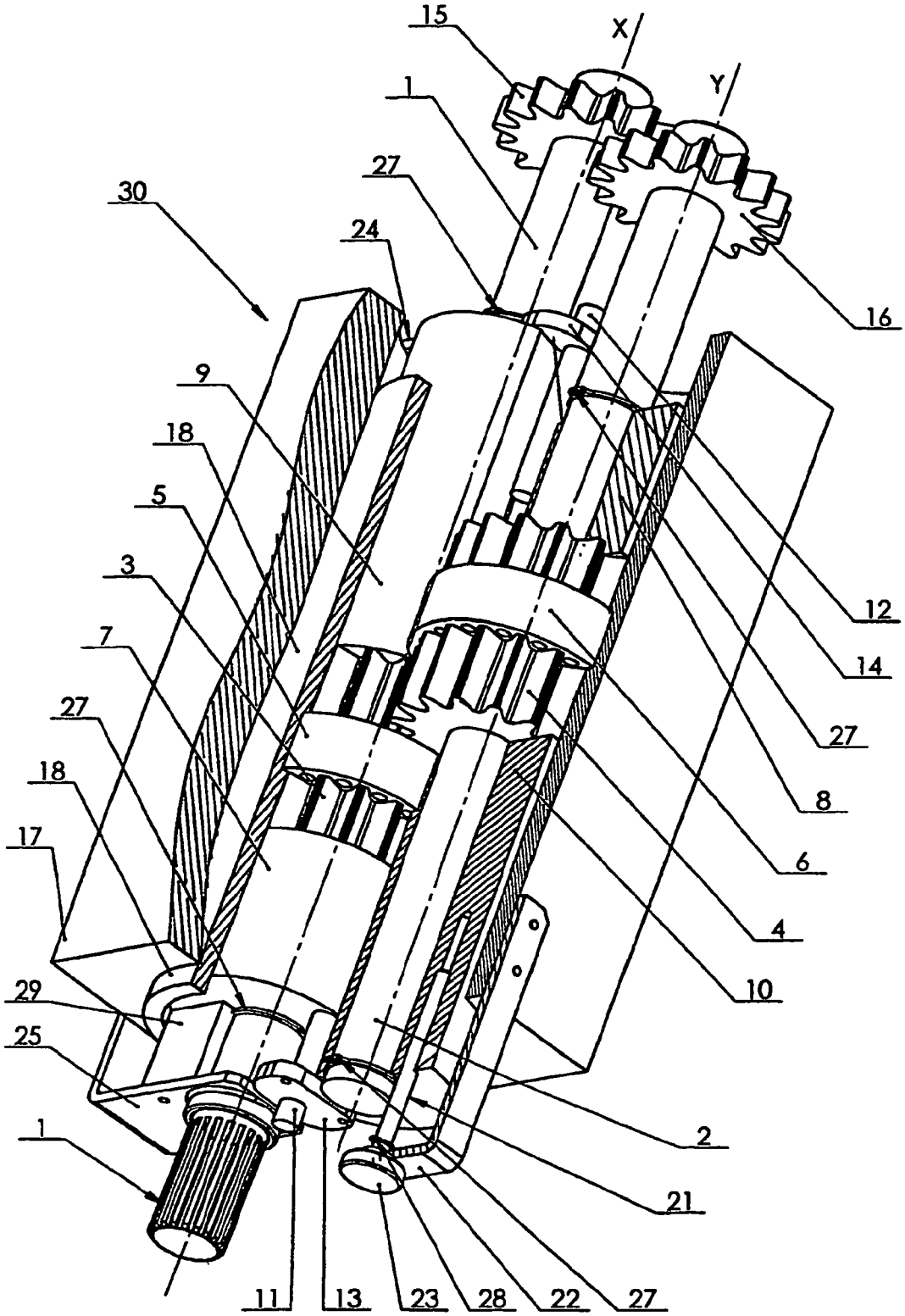
Figure 11:
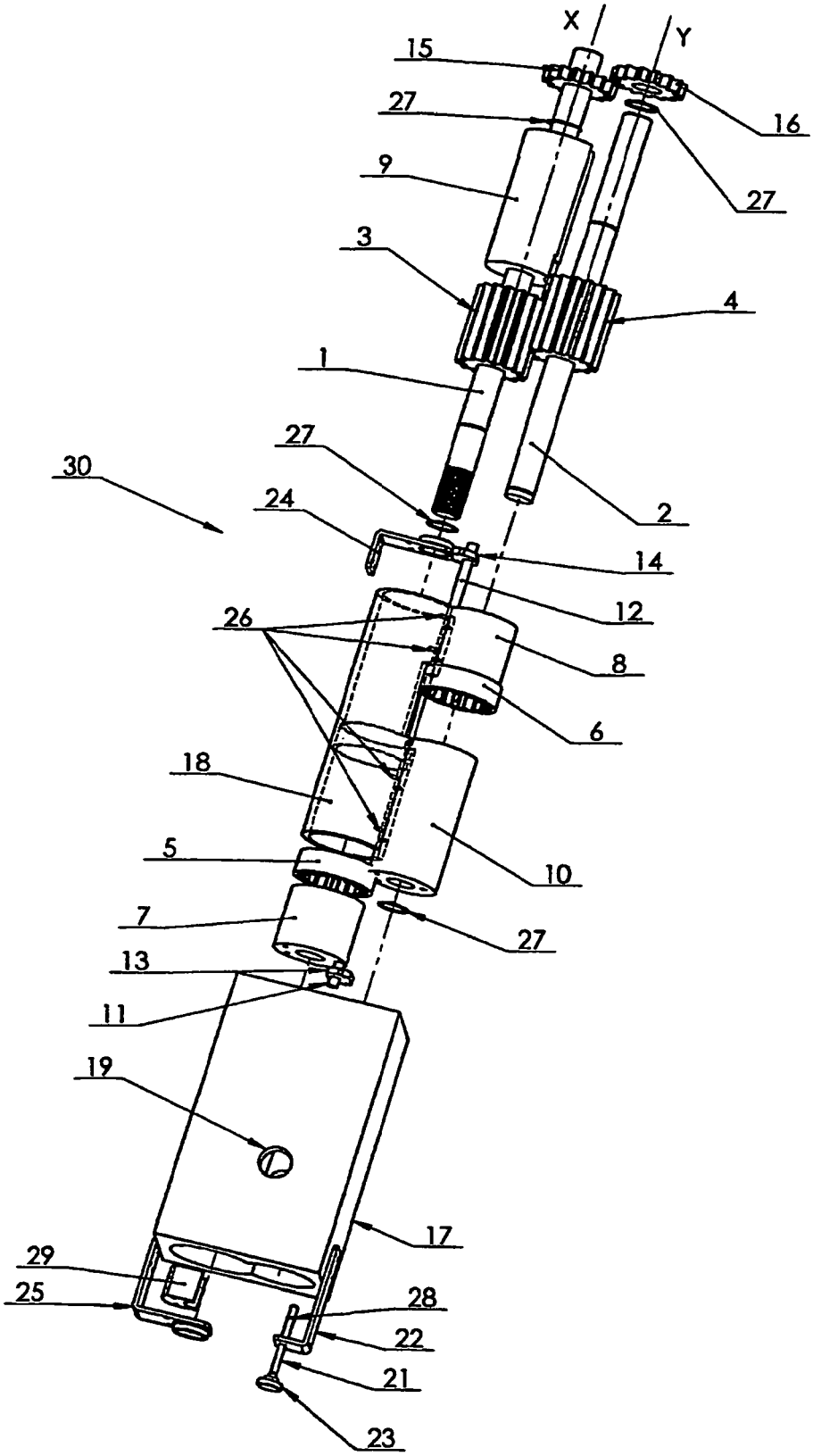
Figure 12:
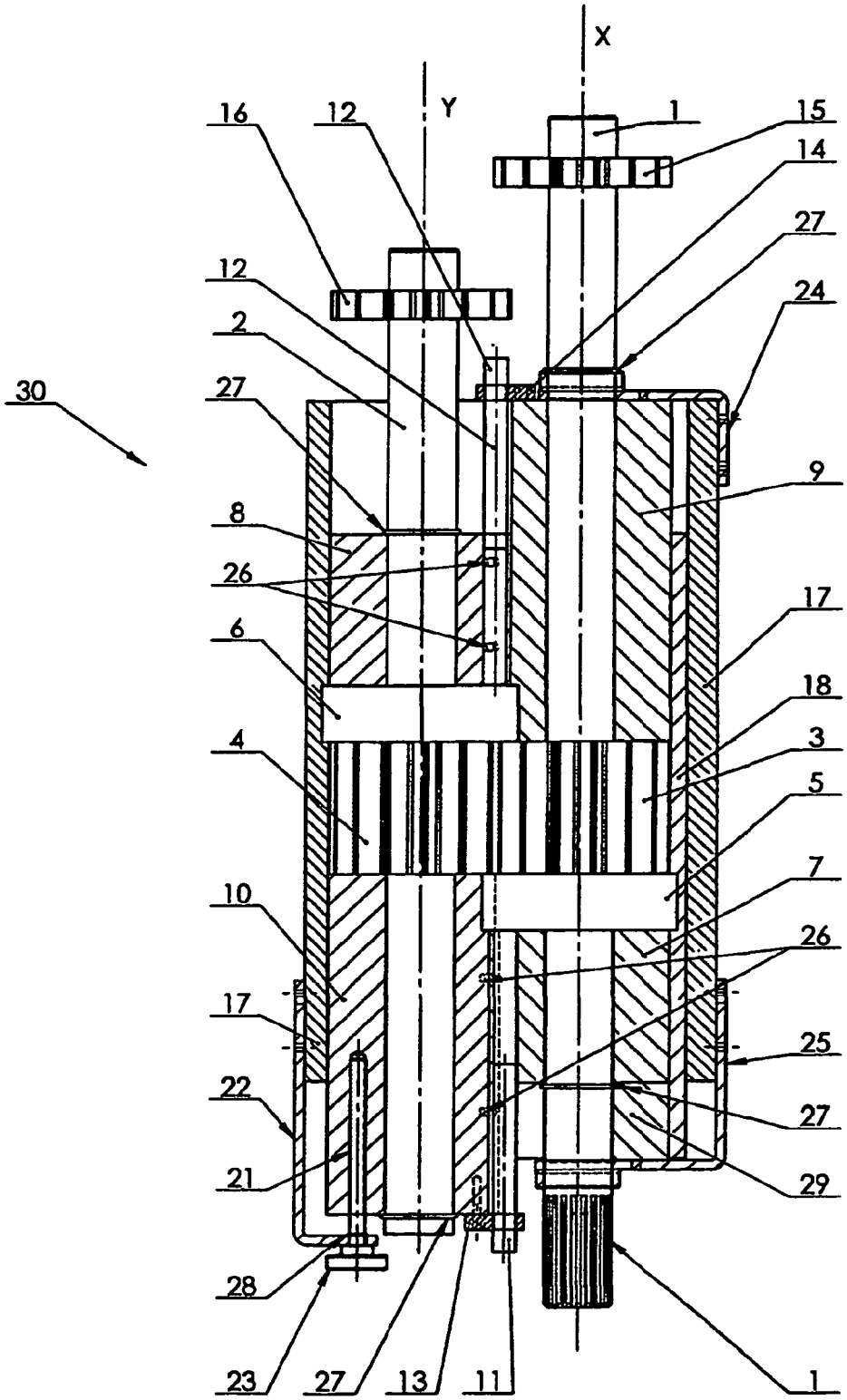
Figure 13:
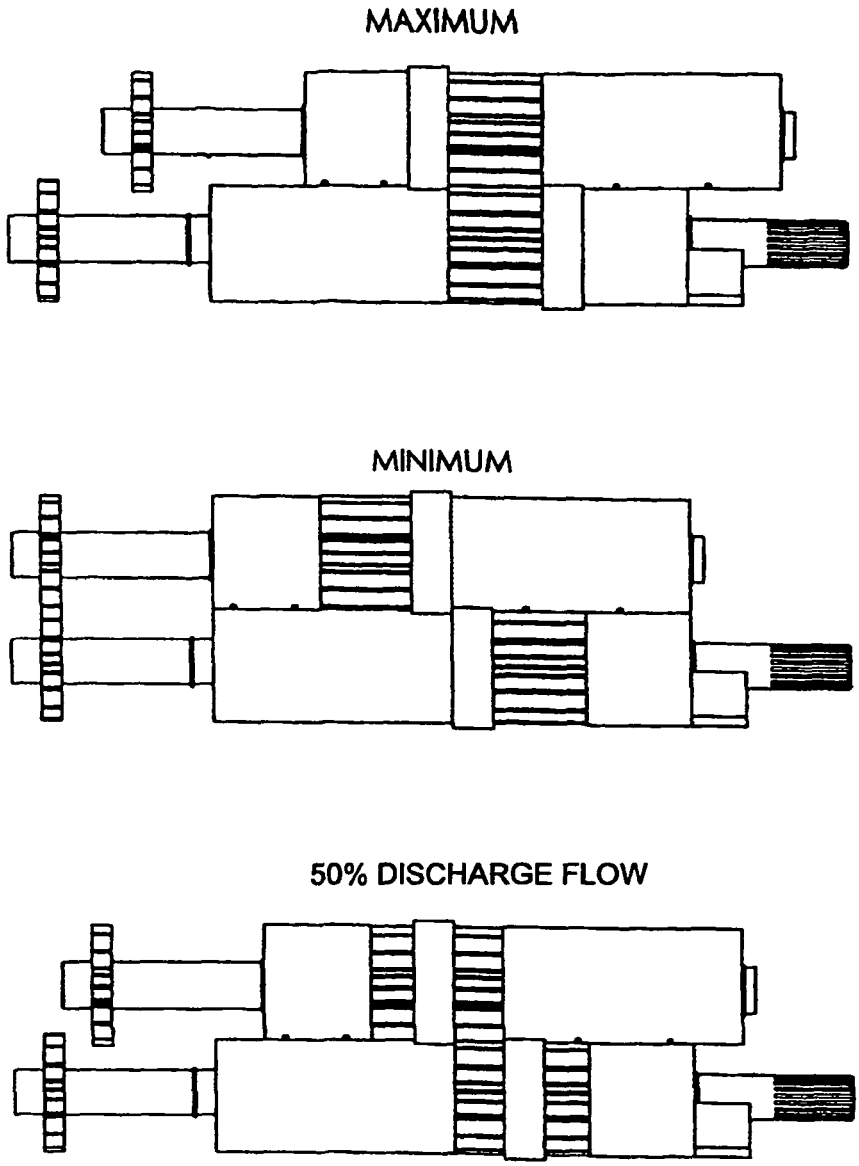
Figure 14:
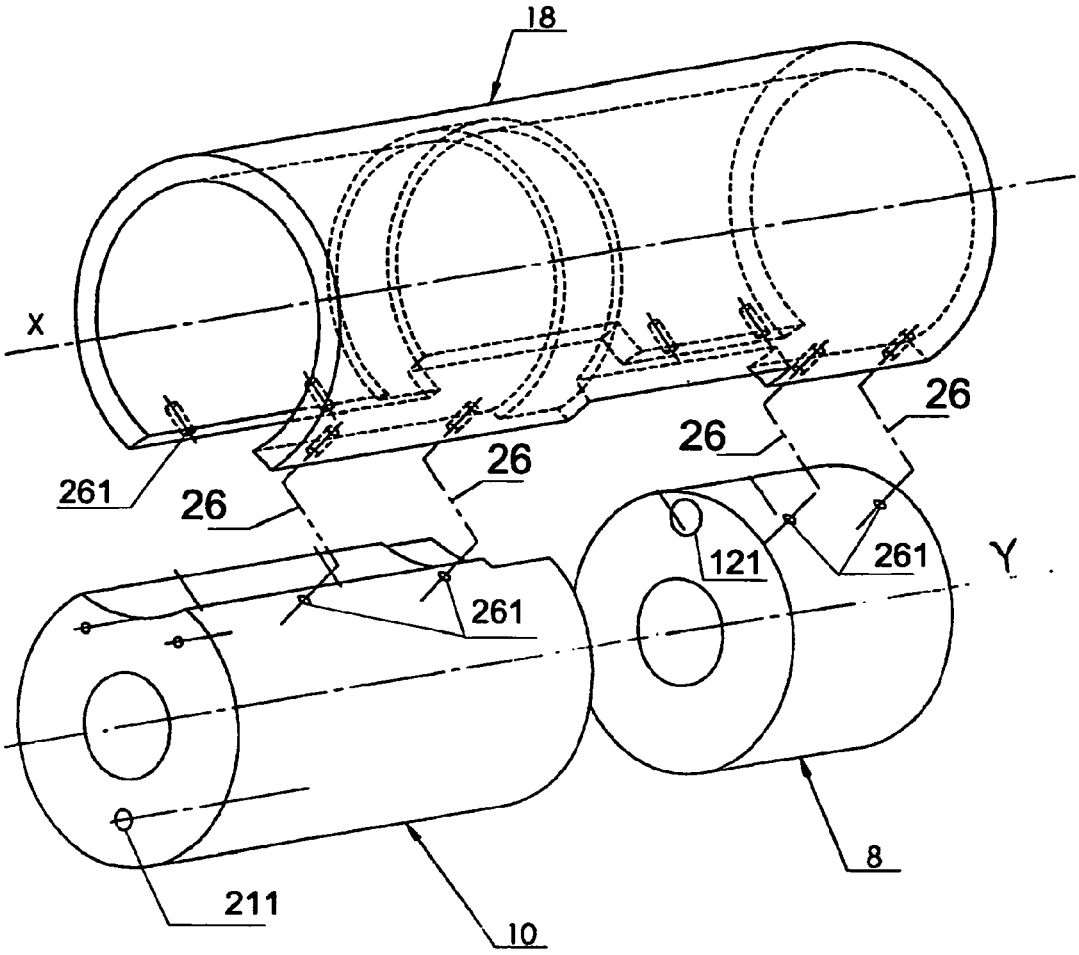
Figure 15:
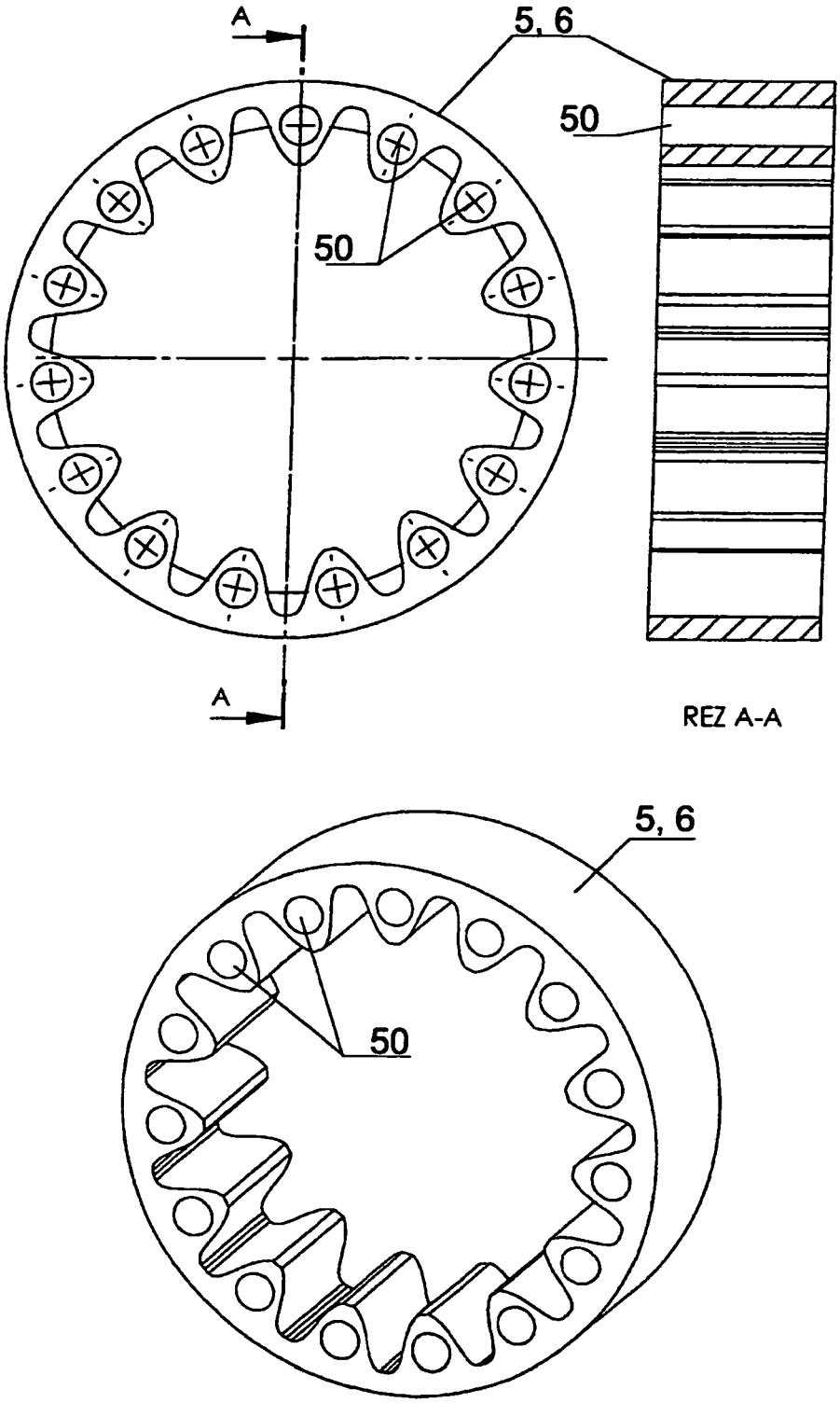
Figure 16:
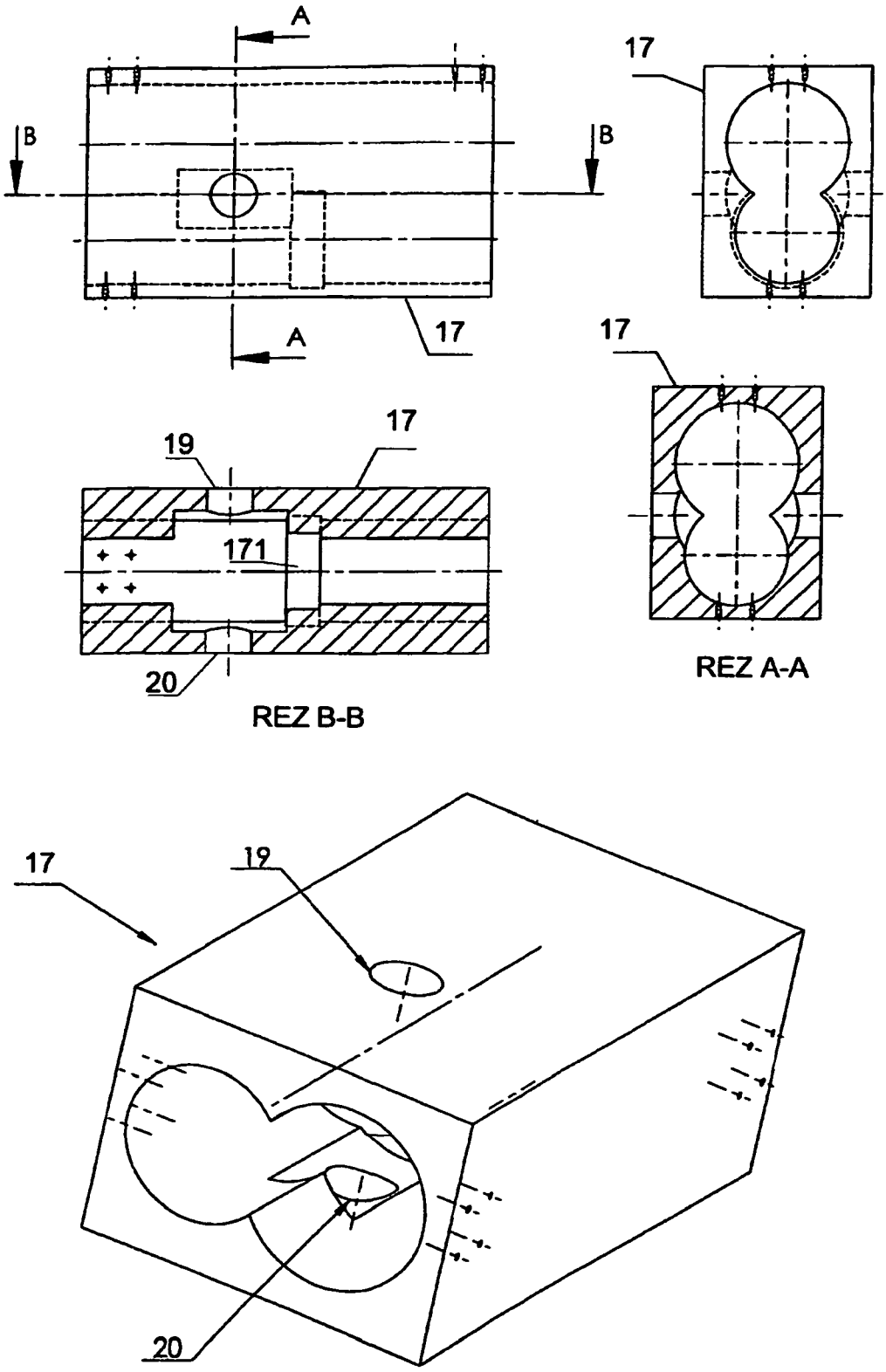
Figure 17:
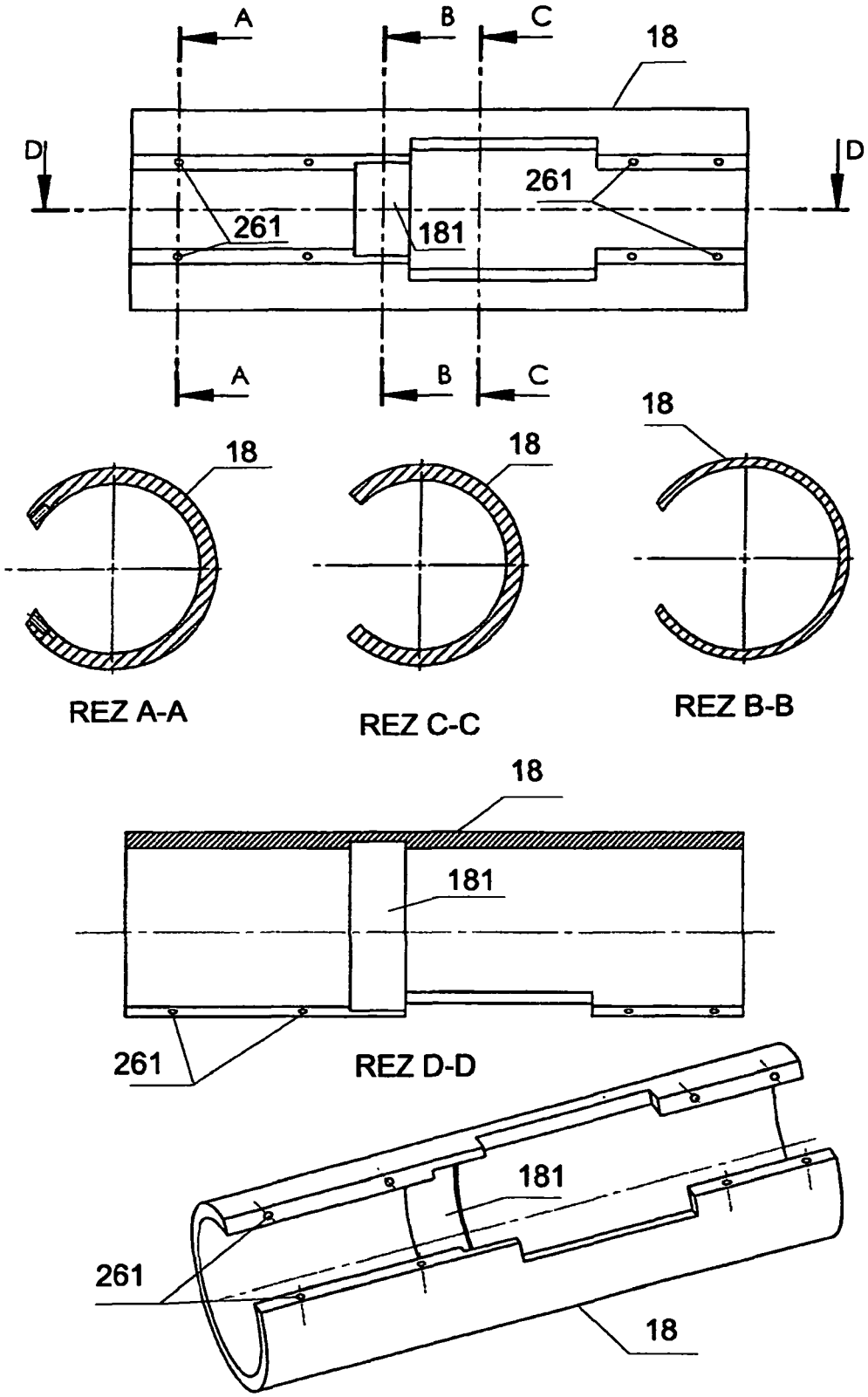
Figure 18:
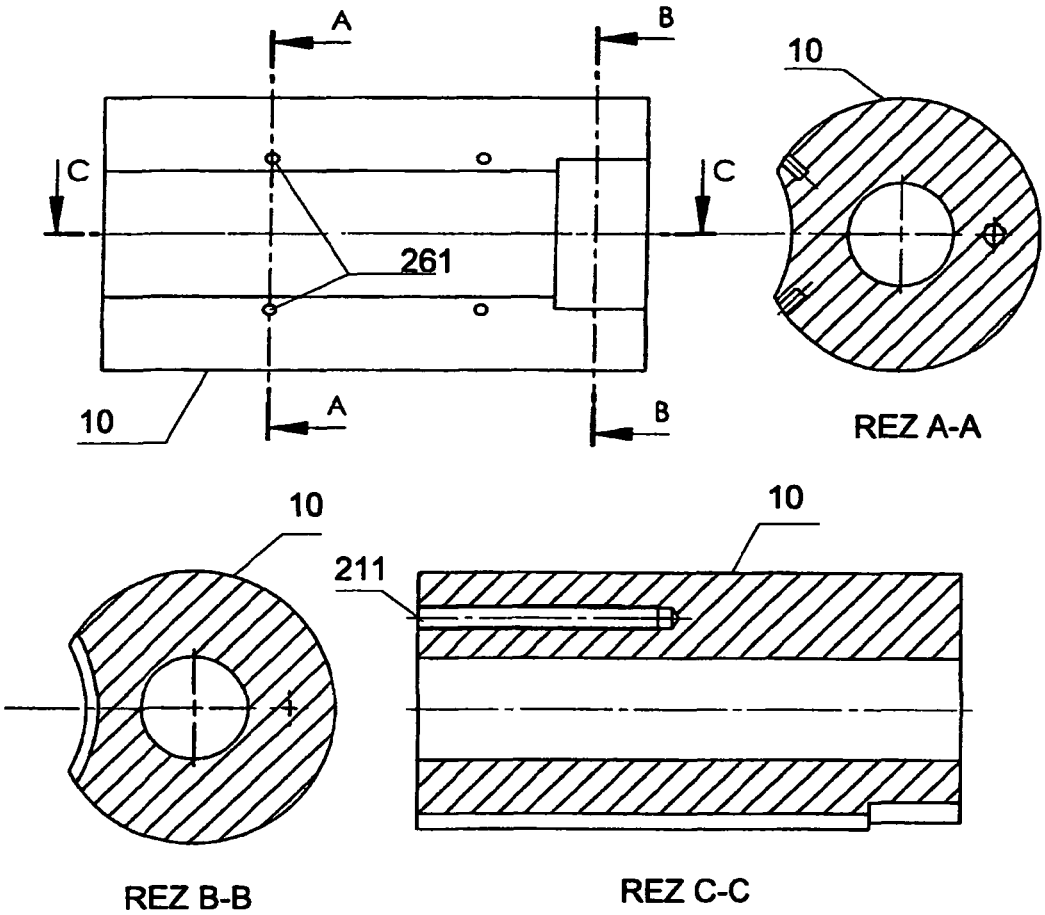
Figure 18:
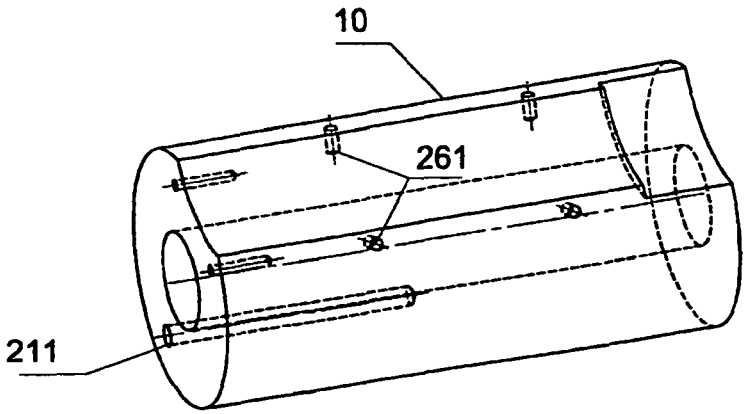
Figure 19:
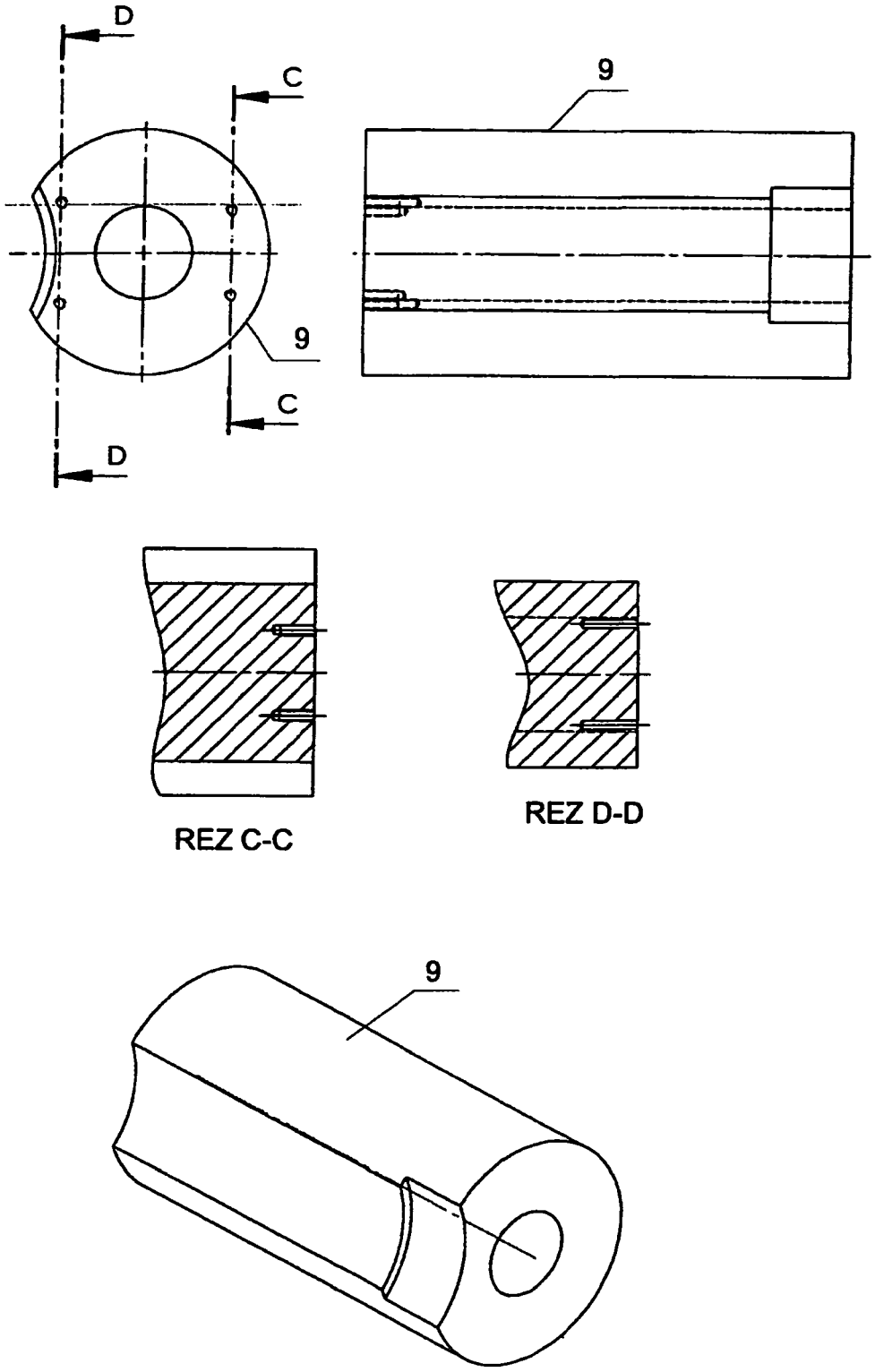
Figure 20:
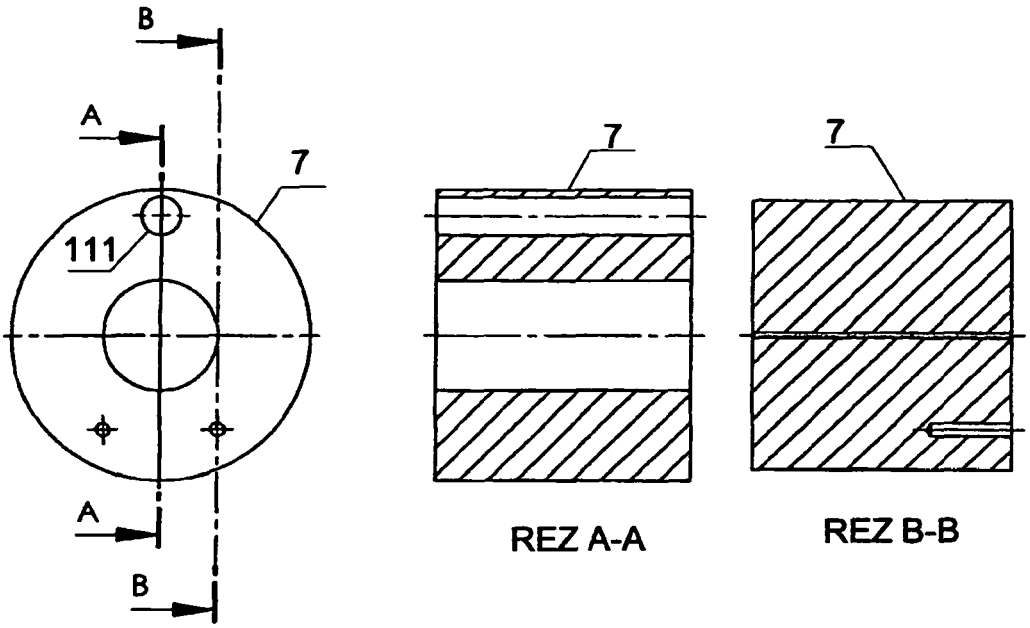
Figure 20:
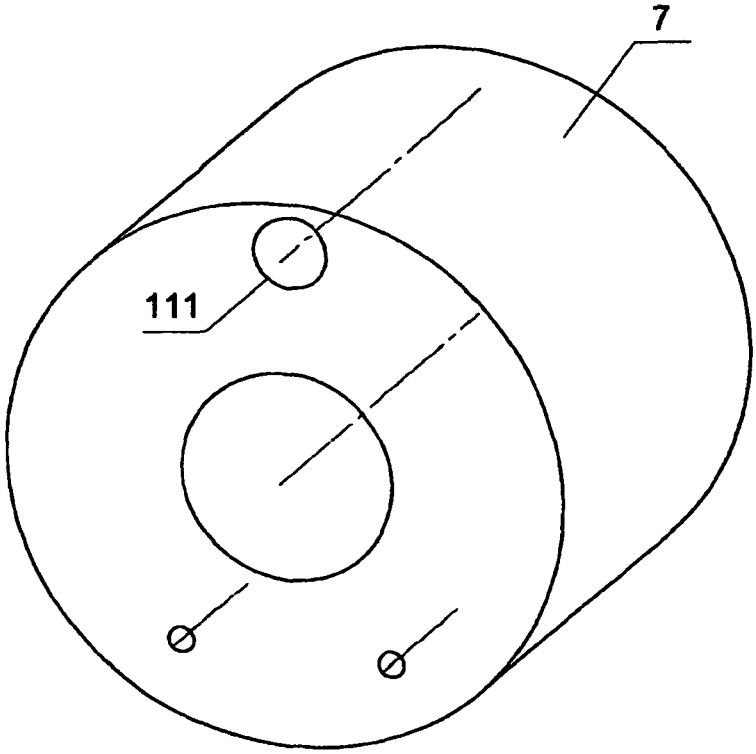
Figure 21:
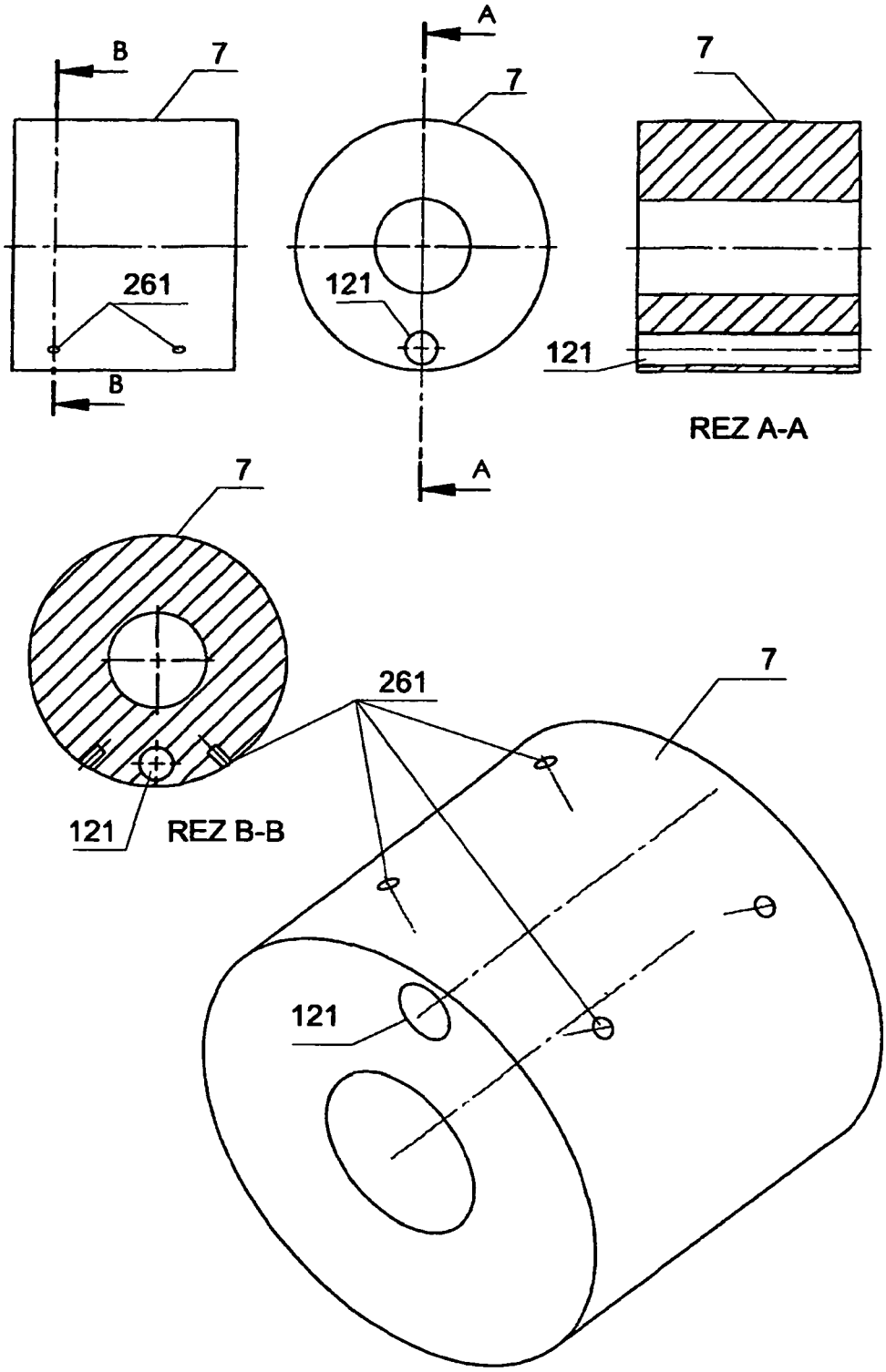

Embodiment of the invention according to FIGS. 1 to 9.

We will produce gears, the first gear 3 and the second gear 4, which will be able to work together as it is with conventional gear pump (they will roll across each other, where at least one tooth of each gear will always be in rolling regime) they will have sufficient length and will have sufficient number of teeth. Gears 3, 4 will rotate on axes X, Y, whose distance will be such, that the most precise rolling of gears 3, 4 would occur.

Rings are made complementary to these gears, the first ring 5 of the first gear 3, the second ring of the second gear 4 which will as precisely as possible follow the shape of teeth, but they will be able to move along the entire length of gears 3, 4. If gears 3, 4 are the same, so rings 5 and 6 will be the same. Ring 5, 6 will comprise flow passages 50.

We slide rings 5, 6 over gears 3, 4, which are laterally shifted against each other about the width of ring 5, 6 and from now on they always be side by side as precisely as possible, being it such that gear 3 will touch side of ring 6 and gear 4 will touch ring 5, but they will be able to separately move along their own axis. Further we will make sufficiently long sealings 7, 8, 9, 10, the first sealing 7 of the first gear 3, the second sealing 9, of the first gear 3, the first sealing 10 of the second gear 4, the second sealing 8 of the second gear 4, which will have such diameter as is diameter of gears 3, 4. They will be made as precisely as possible and sealing 9 and 10 will have longitudinal groove along the entire length with diameter of gears 3, 4 milled out to such depth that axes of rolling gears 3, 4 would stay in the same distance also when these sealing 9, 10 are slid over corresponding axes. Also a groove is milled out in sealing 9 and 10, which will allow free movement of ring provided on the second axis and will provide them a guideway. Thus a part of the pump is made, which will form a unit on axis X consisting of sealing 7 of gear 3, over which ring 5 will be slid, and at the other side of gear 3 there will be sealing 10. Axis Y will comprise sealing 9, gear 4, over which ring 6 is slid and at the other side of gear 4 there will be sealing 8. All this will be connected so that it will not be able to break off, but it will be able to rotate independently on corresponding axes X, Y, except corresponding rings 5, 6 which rotate together with "their" gear 3, 4. If we keep the distance of axes X, Y, and also keep tolerances and certain clearances during production, we will be able to rotate gears 3, 4, these will roll across each other and simultaneously we will be able to move gears along axes X and Y and to change their contact rolling length. The smallest rolling length approaches zero and the greatest rolling length is length of gear 3, 4 (both are the same!) minus width of ring 5, 6 (both of the same width!). Now we state that gear 3 will be immovable along the axis X and gear 4 will move along the axis 4 within range of minimal to maximal rolling length. (Axes X and Y are parallel!). Further, we made sealing sleeve 18 which will partially envelop external diameter of sealing 7, gear 3 and sealing 9 and will contain a groove 181 on the inner side allowing free rotation of ring 5 on the axis X, but at the same time allow inlet of medium to gears 3, 4 and also its outlet. This sealing will move along axis X with ring 5, always likewise with the unit moving along axis Y, but at the same time ring 6 will always be at the same place. Finally, we place the entire device into a case, which will form external housing 17 of whole pump, with a groove 171 for the ring 6, and will allow inlet 19 and outlet 20 of liquid medium as well as all functioning of movements and stabilizations of respective parts.

Embodiment of the Invention According to FIGS. 10 to 21

Pump gear with continuous variable output flow rate, according to the invention, consists of pump housing 17 with inlet hole 19 and outlet hole 20, in which holes for individual parts of gear pump 30 and holes for fixing of stabilizing and moving parts, are milled. Pumping part consists of two gears 3, 4, the first gear 3 and the second gear 4 fixedly mounted on corresponding shafts 1 and 2, the first shaft and the second shaft 2, which are meshing and rolling across each other on corresponding axes X and Y, namely one drive, the first, gear 3, on which the first ring 5 of drive, the first, gear 3, with flow passages 50, is tightly movably fitted, which is in sliding contact with side of driven, the second, gear 4, on which the second ring 6 with flow passages 50 is tightly, movably fitted, which is also in sliding contact with side of drive, the first, gear 3. These gears 3, 4 are movable against each other, with possibility to move only driven, the second, gear 4 along axis Y and drive, the first, gear 3 will remain without possibility to move in direction of axis X. Thereby two functional end positions of gears 3 and 4 are obtained. One is rings 5 and 6 with flow passages 50 are side by side and gears 3 and 4 are not rolling across each other. Auxiliary gears 15 and 16, the first auxiliary gear 15, the second auxiliary gear 16, are engaged in this position and thus gears 3 and 4 will have the same revolutions, which are essential for correct operation of the whole pump 30 mainly in this end position. The first end position has active length of gears 3 and 4 equal to zero and thus no liquid medium is transported by teeth from inlet hole 19 to outlet hole 20, but at the same time in inactive part of gears 3 and 4, which now has maximal possible length, permanently circulates the same medium, which entered there through flow passages in rings 5 and 6 from active part of gears 3 and 4 and a part from compensating cylinders 111 and 112 be means of compensating pistons 11 and 12, the first compensating piston 11, the second compensating piston 12.

These compensating pistons 11 and 12 supply or remove to or from space between teeth, in inactive part of gears 3 and 4, closed by tooth that is at that moment rolling and covering flow passage 50 In any ring 5 or 6, just such volume of liquid medium that no pressure or under-pressure is created in this closed space between teeth, and rings 5 and 6 with flow passages 50 can move along gears 3 and 4 without problems. They move by means of sealings 9 and 10, the second sealing 9 of the first gear 3, the first sealing 10 of the second gear 4, with guideway, which have guiding groove for these rings 5 and 6 and they are provided on corresponding shafts and 2 without a possibility to rotate on their own axis. The other end position—rings 5 and 6 with flow passages 50 are in maximal distance from each other, but they still are entirely on gears 3 and 4, which now has maximal construction length of active part of gears 3 and 4. Inactive length of gears 3 and 4 is now equal to zero and compensating cylinders 111 and 121 with compensating pistons 11 and 12 contain maximal volume of liquid medium. Thereby maximal construction volume of liquid medium is transported from inlet hole 19 to outlet hole 20 of gear pump 30, and all other lengths of active part of gears 3 and 4 represent corresponding volume of transported liquid medium with possibility of continuous regulation. In order to prevent a leak of liquid medium also from the other side of gears 3 and 4, there are sealings 7 and 8, the first sealing 7 of the first gear, the first gear 3, the second sealing 8 of the second gear 4, with compensating cylinder 111 in sealing 7 and compensating cylinder 121 in sealing 8, slid from side over corresponding shafts 1 and 2, being it at the other side as are sealings 9 and 10 with groove. Movement of compensating pistons 11 and 12 in compensating cylinders 111 and 121 in sealings 7 and 8 is directly related to movement of the entire moving system provided on shaft 2 except ring 6 with flow passages 50, and they are fixedly connected with sealings 9 and 10 with guides by means of mounts 13 and 14 of pistons 11 and 12, the first mount 13 of the first piston 11, the second mount 14 of the second piston 12. Outlet hole of compensating cylinders 111 and 121 in sealings 7 and 8 has such shape and size, that total closing of this outlet hole by passing tooth of gear 3 or 4 would never occur.

Figure 22:
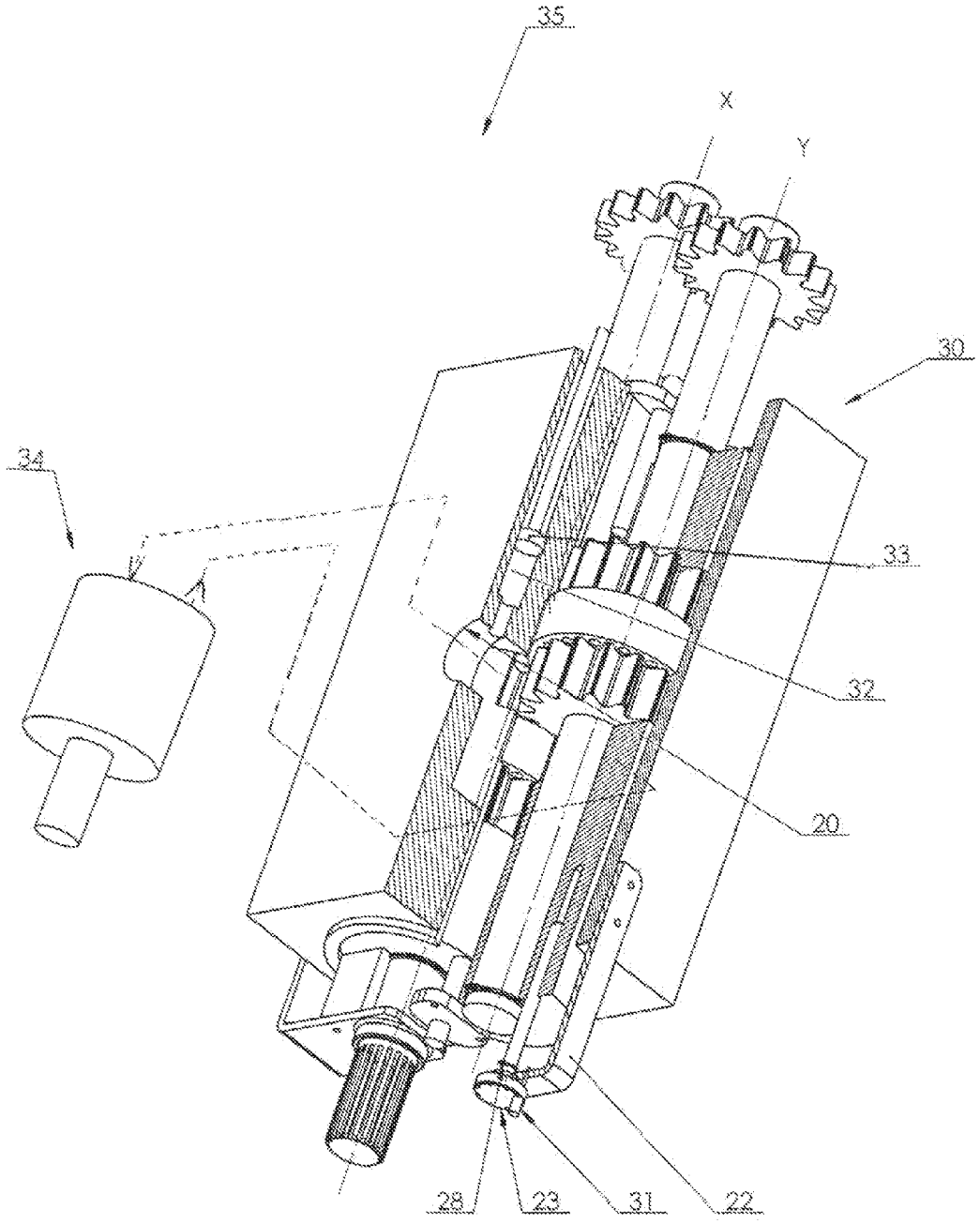
FIG. 22 represents an axonometric section view of the pump connected to the hydro motor forming together the continuous transmission.

The second ring 6 with flow passages 50 can rotate together with the second gear 4 only on its own axis and in groove 171 milled in housing 17 of the pump 30, in which it is placed slidably. Drive, the first, shaft 1 with ability to rotate only on its own axis is supported by means of stabilizers 24 and 25 with bearings, which are fixedly mounted on housing 17 of the pump 30. Stabilizer 24 determines the stop of minimal flow rate of gear pump 30 and serves also for stabilization of the second sealing 9 of the first gear 3 with guideway, without possibility of any movement against housing 17 of the pump 30. Stabilizer 25 of drive, the first, shaft determines maximal flow rate of the pump 30 and also stabilizes, by means of extension stabilizer 29, the first sealing 7 of the first gear 3 with compensating cylinder 111, without a possibility of any movement against housing 17 of the pump 30. Around these stabilized sealings 7 and 9 of drive, the first, gear 3 and the first ring 5 with flow passages 50 movable and sealing sleeve 18 is provided, which has groove 181 milled for the first ring 5, and which is by means of stabilizing pins 26 that are inserted in holes 261 for stabilizing pins 26, connected with sealings 8 and 10, the second sealing 8 of the second gear 4 and the first sealing 10 of the second gear 4. It moves with them by means of shifting mechanism fixedly mounted on housing 7 of the pump 30, consisting of shifting wheel 23, shifting threaded rod with snap ring 28 and shifting thread 211 in the first sealing 10 of the second gear 4, with guideway for the first ring 5 within range of the stops of minimal and maximal flow rate of gear pump 30. FIG. 22 shows a continuous transmission 35 consisting of a hydromotor 34 and the gear pump 30 with continuous variable output flow rate of FIG. 10. The gear pump contains the external compensating system in the form of compensation cylinder 32 and compensation piston 33. It also contains an arrestment 31.

Flow passages 50 in rings 5 and 6 have sufficient dimensions in order to provide the easiest flow of liquid medium from active part C of gears 3 and 4 to inactive part and vice versa.

These flow passages 50 have such shape and are located in rings 5 and 6 so that the flow of liquid medium from higher pressure to lower pressure through side of rolling tooth passing at that time the flow passage 50 of the first ring 5 or the second ring 6, just right through this flow passage 50, is prevented.

The above mentioned examples of embodiments represent basically the simplest embodiments of the pump according to the invention, to understand principle of the invention. It is clear, regarding present description, that the pump can have also other embodiments, all of which would fall within the scope of claims. Mentioned examples are thus illustrative only, whereas they do not present any limitations regarding the claims.

INDUSTRIAL APPLICABILITY

Pump according to the invention can be used individually anywhere, where it is necessary to continuously regulate dosing, flow rates and pressure of liquid substances during operation. Use is considered almost in every branch, such as controlled volume pumps in health, food processing industry, chemical industry, wide use is considered in engineering and transportation. However, the widest use of this device is considered with connection with hydraulic motor or with the same pump designed for function as hydraulic motor and thus provide continuous transmission able to operate from zero output revolutions. Use in transportation can be in bicycles, motorbikes, cars, also in excavators, dredgers, cranes, elevators and also in aviation, military engineering and so.

The invention claimed is:

1. A gear pump having continuous variable output flow rate, the gear pump comprising:

at least one first gear mounted on a first shaft;

at least one second gear mounted on a second shaft, the first gear and the second gear being axially movable against each other, wherein the first gear is sealed at one end by a first seal of the first gear and at a second end by a second seal of the first gear, wherein the first and second seals of the first gear are disposed on the first shaft, wherein the second gear is sealed at a first end by a first seal of the second gear and at second end by a second seal of the second gear, and wherein the first and second seals of the second gear are disposed on the second shaft;

the first gear comprising a first ring having flow passages or a first plurality of segments having flow passages, the first ring or the first plurality of segments disposed tightly co-axially on the first gear, the second gear comprising a second ring having flow passages or a second plurality of segments having flow passages, the second ring or the second plurality of segments disposed tightly co-axially on the second gear, wherein the first ring or the first plurality of segments is movable with the second gear and the second ring or the second plurality of segments is movable with the first gear.

2. The gear pump according of claim 1, wherein the first ring or the first plurality of segments is movable with the second gear by means of a sealing sleeve having a groove that accepts the first ring or the first plurality of segments, and wherein the sealing sleeve is connected with the first and second seals of the second gear.

3. The gear pump according to claim 2, wherein each of the first and second shaft is driven by first and second gears, and wherein hydraulic fluid pressure in a hydraulic motor arrangement provides rotational movement to the first and second gears to drive the first and second shafts.

4. The gear pump according to claim 2, wherein the gear pump is provided with a moving mechanism to change an active length of gear teeth to provide for continuously changing the flow rate during operation of the gear pump.

5. The gear pump according to claim 2, wherein each of the first and second shafts is driven by first and second gears, and wherein hydraulic fluid pressure in a hydraulic motor arrangement provides rotational movement to the first and second gears to drive the first and second shafts.

6. The gear pump according to claim 1, wherein the gear pump is provided with a moving mechanism to change an active length of gear teeth to provide for continuously changing the flow rate during operation of the gear pump.

7. The gear pump according to claim 6, wherein the moving mechanism is fixedly connected to a housing of the gear pump, the moving mechanism comprising a shifting wheel including a shifting threaded rod having a snap ring, and wherein the shifting threaded rod corresponds with a shifting thread in the first seal of the second gear.

8. The gear pump according to claim 6, wherein the moving mechanisms is provided with an arrestment.

9. The gear pump according to claim 6, further comprising an internal compensating system.

10. The gear pump according to claim 6, further comprising an external compensating system connected to an outlet of the gear pump.

11. The gear pump according to claim 1, wherein the gear pump has an internal compensating system.

12. The gear pump according to claim 11, wherein the internal compensating system comprises:

a first compensating cylinder passing through the first seal of the first gear to the first gear;

a first compensating piston fixed in a mount for the first compensating piston, the mount located on the first seal of the second gear;

a second compensating cylinder passing through the second seal of the second gear to the second gear; and a second compensating piston fixed in a mount for the second compensating piston, the mount located on the second seal of the first gear.

13. The gear pump according to claim 11, further comprising an external compensating system connected to an outlet of the gear pump.

14. The gear pump according to claim 1, further comprising an external compensating system connected to an outlet part of the gear pump.

15. The gear pump according to claim 1, further comprising a synchronization system for the first and second gears for providing synchronous revolution of the first and second gears at zero length of active parts of the first and second gears.

16. The gear pump according to claim 15, wherein the synchronization system comprises at least one first auxiliary gear disposed on the first shaft and at least one second auxiliary gear disposed on the second shaft.

17. The gear pump according to claim 1, wherein the first shaft is a drive shaft and the second shaft is a driven shaft.

18. The gear pump according to claim 1, wherein the first shaft is a driven shaft and the second shaft is a drive shaft.

19. The gear pump according to claim 1, wherein each of the first and second shafts is driven by first and second gears, and wherein hydraulic fluid pressure in a hydraulic motor arrangement provides rotational movement to the first and second gears to drive the first and second shafts.

20. A continuous transmission having a gear pump, the gear pump comprising:

at least one first gear mounted on a first shaft;

at least one second gear mounted on a second shaft, the first gear and the second gear being axially movable against each other, the first gear comprising a first ring having flow passages, the first ring fitted on the first gear tightly co-axially, the second gear comprising a second ring having flow passages, the second ring fitted on the second gear tightly co-axially, wherein the first ring is movable with the second gear and the second ring is movable with the first gear, the first gear is sealed at a first end by a first seal of the first gear and at a second end by a second seal of the first gear, wherein the first and second seals of the first gear are arranged on the first shaft, wherein the second sear is sealed at a first end b the first seal of the second gear and at a second end by the second seal of the second gear, and wherein the first and second seals of the second sear are arranged on the second shaft.

21. The continuous transmission according to claim 20, wherein the first ring is movable with the second gear by a sealing sleeve having a groove that accepts the first ring, and wherein the sealing sleeve is connected with the first and second seals of the second gear.

* * * * *